US009702382B2

(12) United States Patent
Hsu et al.

(10) Patent No.: US 9,702,382 B2
(45) Date of Patent: Jul. 11, 2017

(54) OIL HYDRAULIC CYLINDER AND SPINDLE THEREOF

(71) Applicant: WORLD FRIENDSHIP CO., LTD., Taipei (TW)

(72) Inventors: Kun-Shan Hsu, Chiayi (TW); Mike S.C. Cheng, Taipei (TW)

(73) Assignee: WORLD FRIENDSHIP CO., LTD., Taipei (TW)

( * ) Notice: Subject to any disclaimer, the term of this patent is extended or adjusted under 35 U.S.C. 154(b) by 303 days.

(21) Appl. No.: 14/571,378

(22) Filed: Dec. 16, 2014

(65) Prior Publication Data

US 2016/0169254 A1 Jun. 16, 2016

(51) Int. Cl.
*F15B 15/02* (2006.01)
*F15B 15/14* (2006.01)

(52) U.S. Cl.
CPC ..... *F15B 15/02* (2013.01); *F15B 15/1447* (2013.01)

(58) Field of Classification Search
CPC ..... F16J 1/02; Y10S 92/01
USPC ..... 92/155, 165 R, 260
See application file for complete search history.

(56) References Cited

U.S. PATENT DOCUMENTS 3,149,543 A * 9/1964 Naab ..... F16J 9/28 277/434
3,212,411 A * 10/1965 Storms ..... F04B 39/0005 285/909
3,808,956 A * 5/1974 Knapp ..... F16J 1/12 29/888.044
4,076,103 A * 2/1978 Wallis ..... F16F 9/3278 184/25
4,087,076 A * 5/1978 Getty ..... B66F 3/30 254/93 R
6,470,788 B2 * 10/2002 Specht ..... B60R 21/268 92/155
6,681,682 B2 * 1/2004 Niwa ..... F15B 15/1433 92/153
7,762,177 B2 * 7/2010 Fischer ..... F15B 15/1452 277/468

* cited by examiner

*Primary Examiner* — Thomas E Lazo
(74) *Attorney, Agent, or Firm* — Li & Cai Intellectual Property (USA) Office

(57) ABSTRACT

A spindle of an oil hydraulic cylinder includes a main body and a circular ring shaped copper coat. The main body defines a central axis and has a large diameter segment and a small diameter segment integrally extended from the large diameter segment. The copper coat is brazed on an outer surface of the large diameter segment. The center of the copper coat is arranged at the central axis, and the radius of the spindle is greatest at a portion of the spindle coated by the copper coat. The abrasion resistance of the copper coat is greater than the abrasion resistance of the main body. Thus, the spindle of the instant disclosure is a composite structure and is provided for reducing abrasion. Additionally, the instant disclosure also provides an oil hydraulic cylinder.

10 Claims, 8 Drawing Sheets

OIL HYDRAULIC CYLINDER AND SPINDLE THEREOF

BACKGROUND OF THE INVENTION

1. Field of the Invention

The invention relates to a cylinder; in particular, to an oil hydraulic cylinder and a spindle thereof provided with a surface protecting coat.

2. Description of Related Art

The conventional oil hydraulic cylinder has a cylinder body and a spindle received in the cylinder body. The spindle is movable in the cylinder body, and the spindle rubs against the inner wall of the cylinder body when the spindle moves in the cylinder body. Thus, the spindle needs high abrasion resistance and high strength, so the spindle is usually integrally formed by a material having high abrasion resistance and high strength.

However, the portion of the spindle rubbing against the cylinder body is a small part of the spindle, and the material of the entire spindle needs to be chosen to satisfy requirements for a small part of the spindle, such that the cost of the spindle cannot be decreased. Moreover, when the spindle is worn out, the entire spindle must be thrown away, creating a wasteful situation.

To achieve the abovementioned improvement, the inventors strive via industrial experience and academic research to present the instant disclosure, which can provide additional improvement as mentioned above.

SUMMARY OF THE INVENTION

The instant disclosure provides an oil hydraulic cylinder and a spindle thereof for solving the problem generated by the conventional spindle.

One embodiment of the invention provides an oil hydraulic cylinder, comprising: a cylinder body having an inner surface, wherein the inner surface defines an opening and a space, the space is in air communication with the opening; a spindle defining a central axis, wherein the spindle is movable in the space of the cylinder body along the central axis, and the spindle comprises: a main body having a large diameter segment and a small diameter segment integrally extended from the large diameter segment, wherein a gap exists between an outer surface of the small diameter segment and the inner surface of the cylinder body, wherein the small diameter segment has an end portion away from the large diameter segment, the end portion of the small diameter segment is arranged at the opening of the cylinder body; and a surface protecting coat brazed on an outer surface of the large diameter segment, wherein the abrasion resistance of the surface protecting coat is greater than the abrasion resistance of the main body, and the surface protecting coat contacts the inner surface of the cylinder body; a push seat fixed on the end portion of the small diameter segment; and a covering module arranged at the opening of the cylinder body and at least partially arranged between the outer surface of the small diameter segment and the inner surface of the cylinder body, wherein the covering module abuts the outer surface of the small diameter segment and the inner surface of the cylinder body without any clearance.

The embodiment of the invention also provides a spindle of an oil hydraulic cylinder defining a central axis, comprising: a main body having a large diameter segment and a small diameter segment integrally extended from the large diameter segment; and a circular ring shaped copper coat brazed on an outer surface of the large diameter segment, wherein a center of the copper coat is arranged at the central axis, the portion of the spindle having the greatest radius is the portion of the spindle coated by the copper coat, the abrasion resistance of the copper coat is greater than the abrasion resistance of the main body.

In summary, the spindle of the oil hydraulic cylinder of the instant disclosure is formed by brazing the surface protecting coat (e.g., copper coat) on the large diameter segment of the main body, so that when choosing the material of the spindle, the abrasion resistance of the main body can be lower than the abrasion resistance of the surface protecting coat, thereby reducing the cost of the spindle and reducing the abrasion between the spindle and the inner surface of the cylinder body to improve the service life and the utilization of the spindle.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Please refer to FIGS. 1 through 8, which show an embodiment of the instant disclosure. References are hereunder made to the detailed descriptions and appended drawings in connection with the instant disclosure. However, the appended drawings are merely shown for exemplary purposes, rather than being used to restrict the scope of the instant disclosure.

Figure 1:
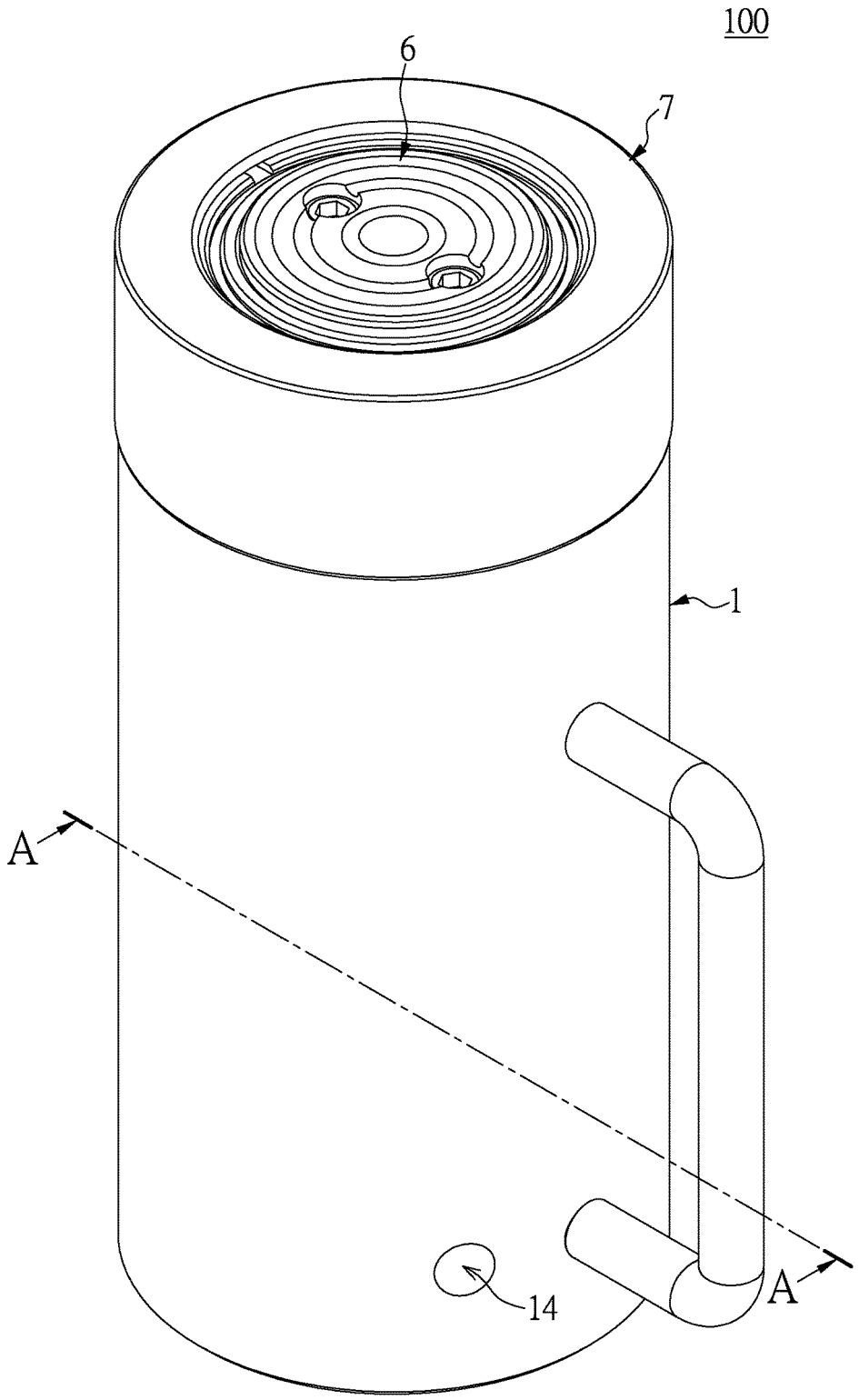
FIG. 1 is a perspective view showing an oil hydraulic cylinder according to the instant disclosure.
Figure 2:
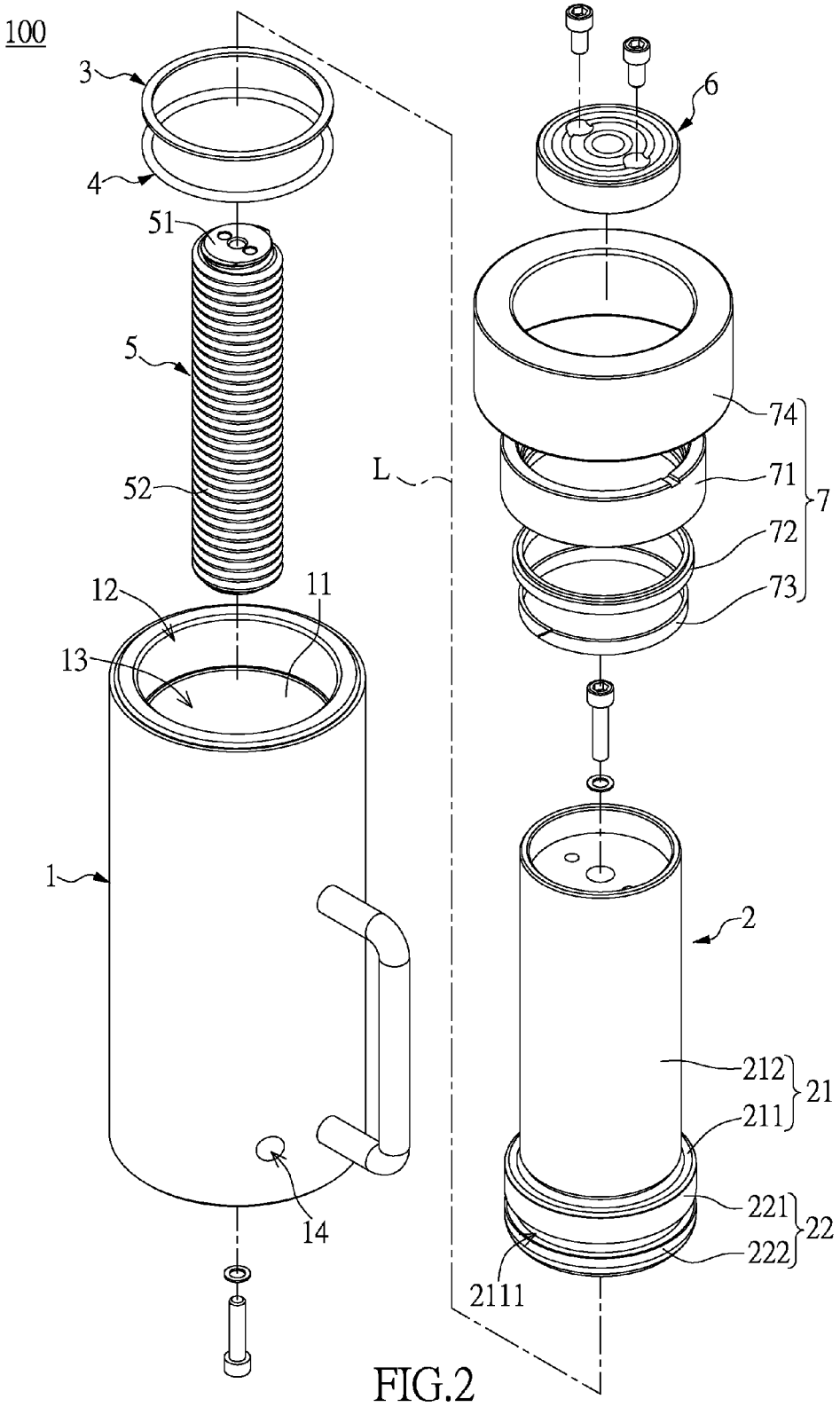
FIG. 2 is an exploded view of the oil hydraulic cylinder as shown in FIG. 1.
Figure 3:
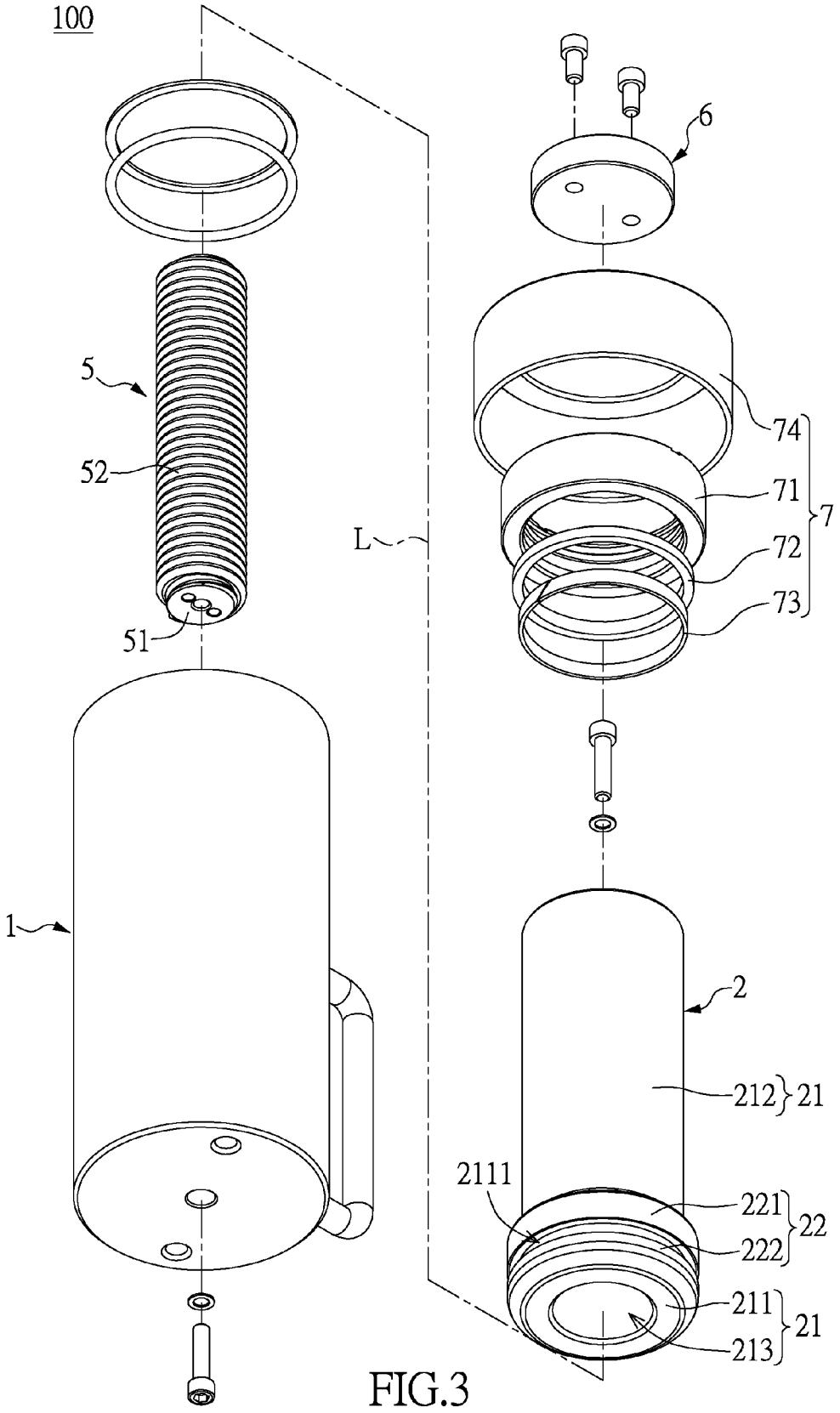
FIG. 3 is an exploded view of the oil hydraulic cylinder as shown in FIG. 1 from another viewing angle.
Figure 5:
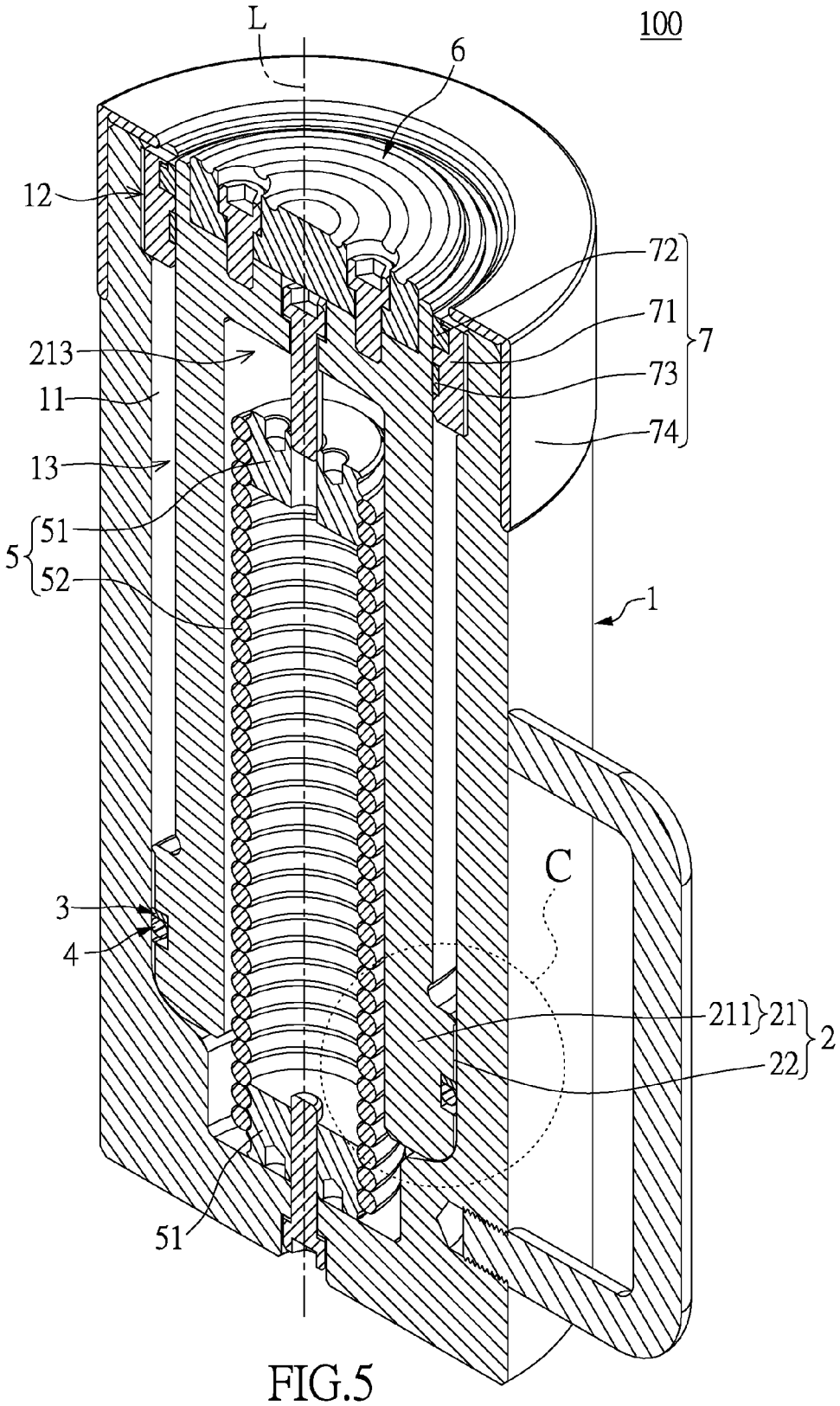
FIG. 5 is a cross-sectional view of the oil hydraulic cylinder.

As shown in FIGS. 1 through 3, the embodiment provides an oil hydraulic cylinder 100 including a cylinder body 1, a spindle 2, a gasket 3, an O-ring 4, a spring module 5, a push seat 6, and a covering module 7. The gasket 3 and the O-ring 4 are disposed on one end of the spindle 2 (e.g., the bottom end of the spindle 2 as shown in FIG. 5), and the push seat 6 is disposed on another end of the spindle 2 (e.g., the top end of the spindle 2 as shown in FIG. 5). The spindle 2 and the spring module 5 are received in the cylinder body 1, the spring module 5 connects the spindle 2 and the cylinder body 1, and the covering module 7 is approximately arranged between the spindle 2 and the cylinder body 1. The following description respectively discloses the components of the oil hydraulic cylinder 100 and the relationship therebetween.

Please refer to FIGS. 2, 3, and 5. The cylinder body 1 has an inner surface 11, and the inner surface 11 defines an opening 12 and a space 13 in air communication with the opening 11. Moreover, the cylinder body 1 has a hole 14 penetrating from the outer surface thereof to the inner wall 11, and the hole 14 is used for dissipating air pressure of the oil hydraulic cylinder 100.

Figure 4:
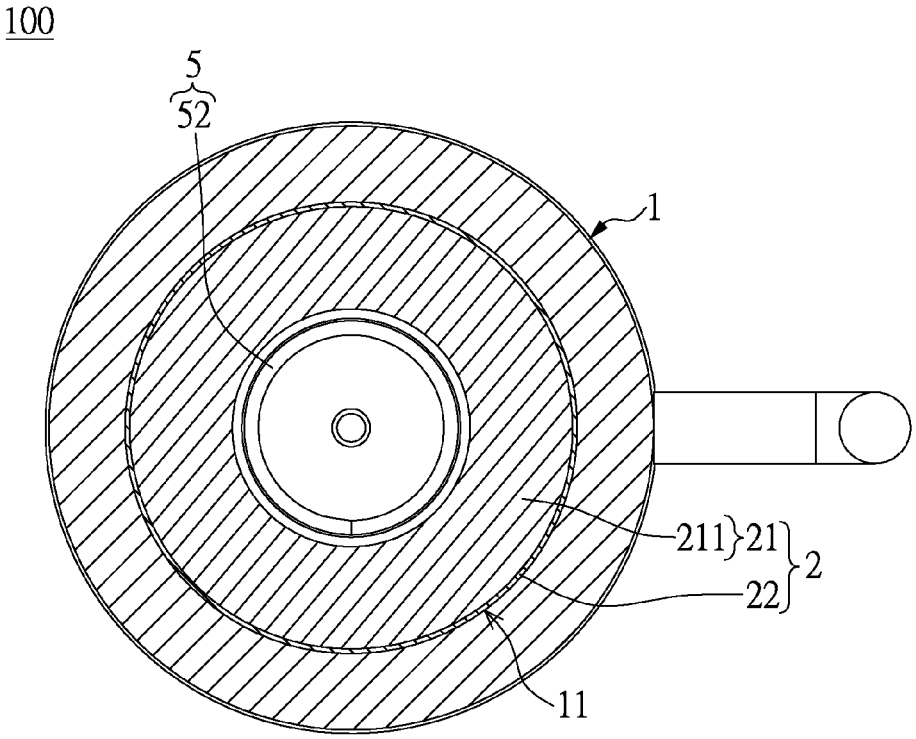
FIG. 4 is a cross-sectional view of the oil hydraulic cylinder as shown in FIG. 1 along line A-A.

The spindle 2 defines a central axis L, and the spindle 2 is substantially symmetrical to the central axis L. The spindle 2 is movable in the space 13 of the cylinder body 1 along the central axis L. The spindle 2 has a main body 21 and a ring-shaped surface protecting coat 22 brazed on the main body 21. The surface protecting coat 22 in the instant embodiment is a copper coat for example, that is to say, the spindle 2 is formed by brazing copper onto the main body 21, but the surface protecting coat 22 is not limited thereto. The portion of the spindle 2 having the greatest radius is the portion of the spindle 2 coated by the surface protecting coat 22, and the spindle 2 contacts the inner surface 11 of the cylinder body 1 only by the surface protecting coat 2 (as shown in FIGS. 4 and 5).

The main body 21 has a large diameter segment 211 and a small diameter segment 212 integrally extended from the large diameter segment 211. The radius of the large diameter segment 211 is larger than the radius of the small diameter segment 212, and the length of the large diameter segment 211 in the direction of the central axis L is smaller than the length of the small diameter segment 212 in the direction of the central axis L.

Figure 6:
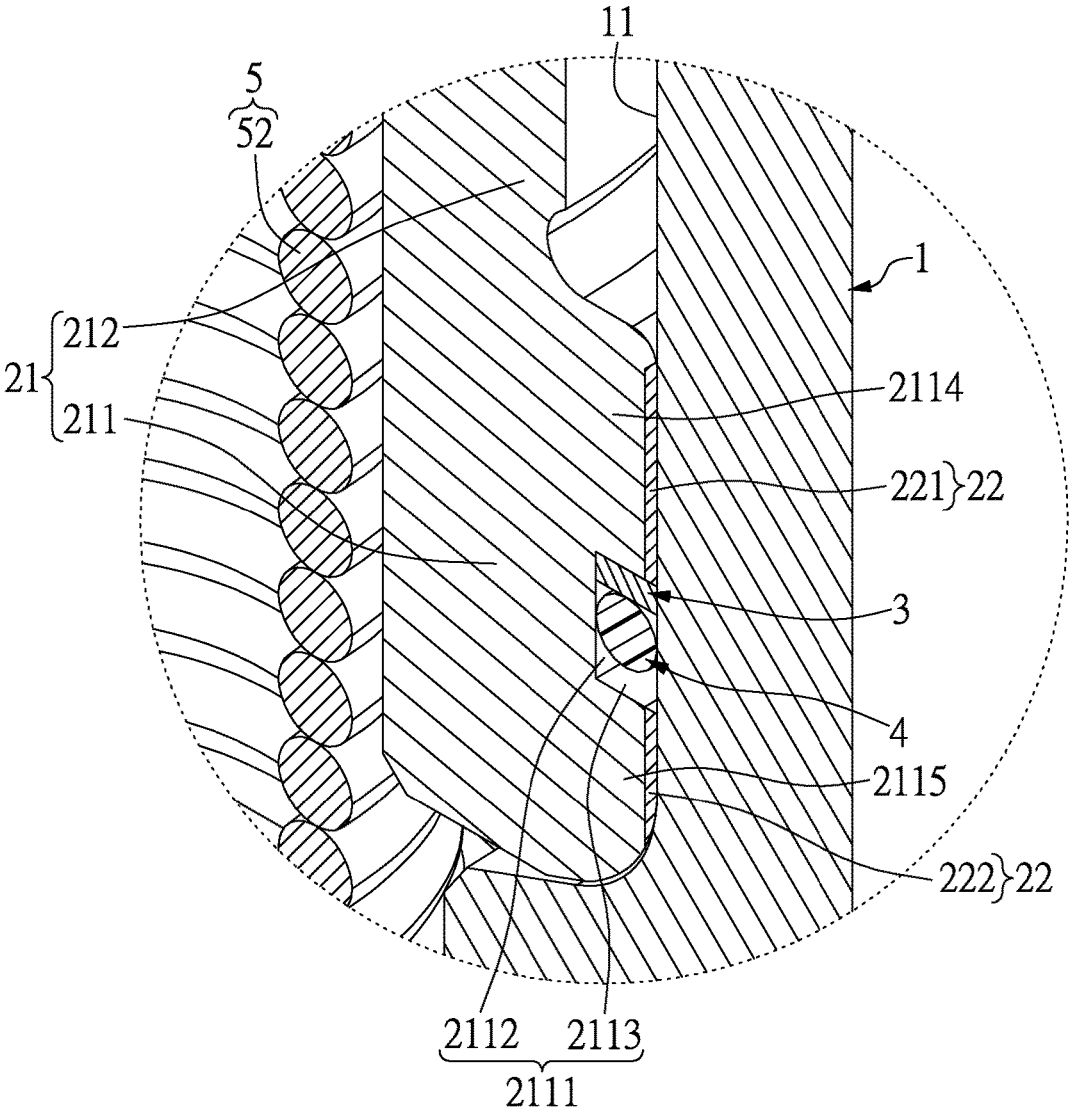
FIG. 6 is an enlarged view of the portion C of the oil hydraulic cylinder as shown in FIG. 5.

The large diameter segment 211 of the main body 21 has a ring-shaped accommodating groove 2111 recessed from the outer surface thereof adjacent to the inner surface 11 of the cylinder body 1, and the depth of the accommodating groove 2111 is uniform. A center of the accommodating groove 2111 is arranged at the central axis L. The accommodating groove 2111 has a bottom wall 2112 and two side walls 2113 connected to the bottom wall 2112 (as shown in FIG. 6). The main body 21 has a receiving slot 213 recessed from the bottom surface of the large diameter segment 211 (as shown in FIG. 3) toward the small diameter segment 212 along the central axis L.

Figure 7:
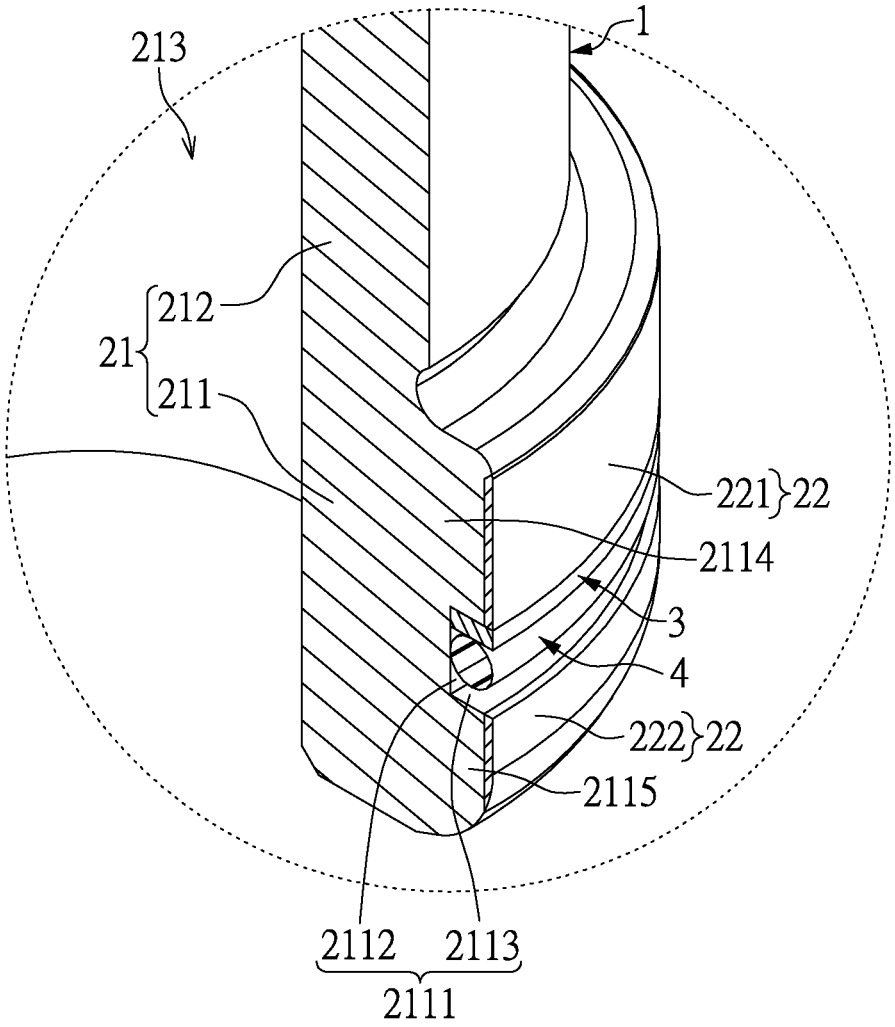
FIG. 7 is a perspective view of FIG. 6 without the cylinder body and the spring module.
Figure 8:
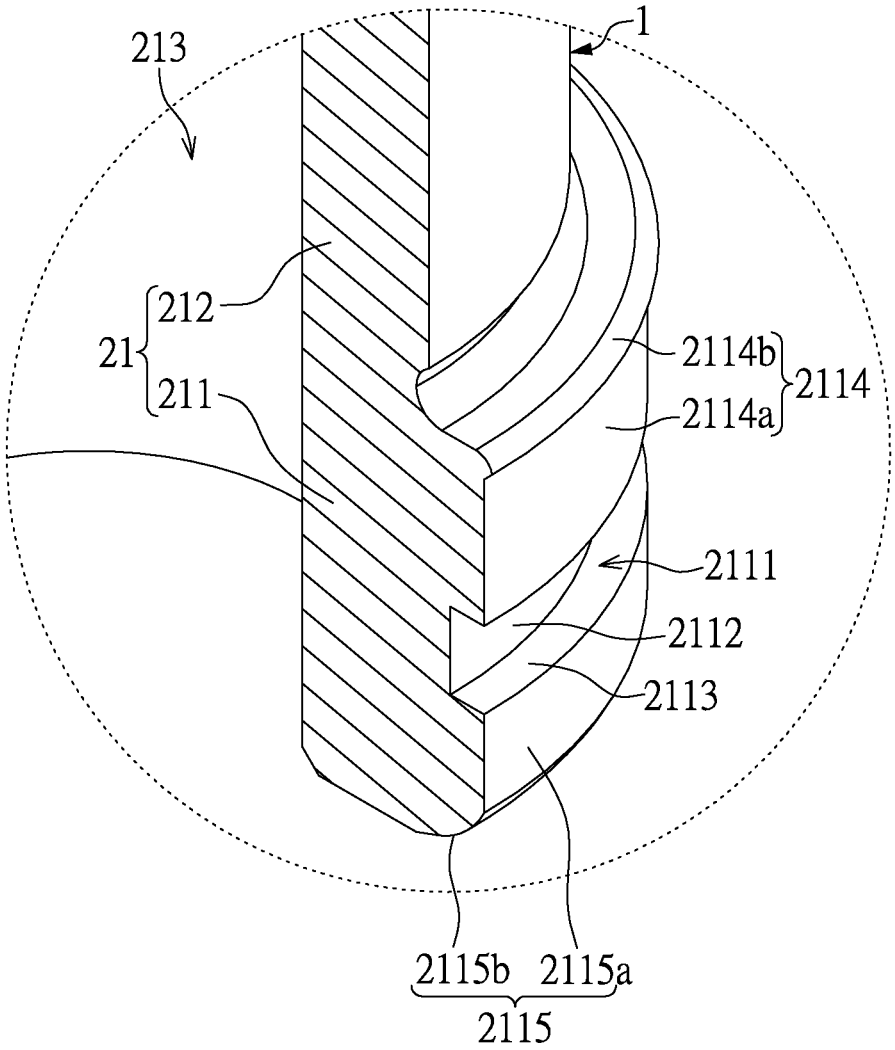
FIG. 8 is perspective view showing the spindle of FIG. 6.

Moreover, please refer to FIGS. 6 through 8. The large diameter segment 211 defines a first connecting portion 2114 and a second connecting portion 2115, the first connecting portion 2114 and the second connecting portion 2115 are respectively arranged at two opposite sides of the accommodating groove 2111 (e.g., the upper side and the lower side of the accommodating groove 2111 as shown in FIG. 6), and the first connecting portion 2114 is arranged close to the small diameter segment 212 with respect to the second connecting portion 2115. A gap exists between an outer surface of the small diameter segment 212 and the inner surface 11 of the cylinder body 1. The small diameter segment 212 has an end portion (e.g., the top end portion of the small diameter segment 212 as shown in FIG. 5) away from the large diameter segment 211, and the end portion of the small diameter segment 212 is arranged at the opening 12 of the cylinder body 1.

The surface protecting coat 22 is brazed on the outer surface of the large diameter segment 211 of the main body 21. The abrasion resistance of the surface protecting coat 22 is greater than the abrasion resistance of the main body 21. The surface protecting coat 22 substantially contacts the inner surface 11 of the cylinder body 1. Namely, the spindle 2 is formed by brazing copper onto the main body 21, such that the material of the main body 21 of the spindle 2 can be chosen with lower abrasion resistance and lower strength for reducing the cost of the spindle 2. When the surface protecting coat 22 is subject to a certain abrasion, the surface protecting coat 22 can be fixed, such that the spindle can be used again to avoid throwing away the spindle 2.

The surface protecting coat 22 in the instant embodiment is divided into a first brazing portion 221 and a second brazing portion 222 by the accommodating groove 2111. Each of the first brazing portion 221 and the second brazing portion 222 is ring-shaped, and the radii of the first brazing portion 221 and the second brazing portion 222 are approximately identical. The center of the first brazing portion 221 and the center of the second brazing portion 222 are arranged at the central axis L. The first brazing portion 221 and the second brazing portion 222 are respectively brazed on the first connecting portion 2114 and the second connecting portion 2115 of the large diameter segment 211. The edges of the first brazing portion 221 and the second brazing portion 222, which are adjacent to each other (e.g., the bottom edge of the first brazing portion 221 and the top edge of the second brazing portion 222 as shown in FIG. 7), respectively align with (e.g., are coplanar with) the side walls of the accommodating groove 2111.

Specifically, the first connecting portion 2114 has a connecting surface 2114*a* and a flange 2114*b*. The connecting surface 2114*a* is a ring-shaped outer surface of the first connecting portion 2114 adjacent to the inner surface 11 of the cylinder body 1. The flange 2114*b* is outwardly extended from an edge of the connecting surface 2114*a* (e.g., the top edge of the connecting surface 2114*a* as shown in FIG. 8) adjacent to the small diameter segment 212. The first brazing portion 221 is brazed on the connecting surface 2114*a*, and an edge of the first brazing portion 221 (e.g., the top edge of the first brazing portion 221 as shown in FIG. 7) away from the accommodating groove 2111 is brazed on the flange 2114*b* (as shown in FIG. 8).

Moreover, the second connecting portion 2115 has a connecting surface 2115*a* and an arc surface 2115*b* connecting to the connecting surface 2115*a*. The connecting surface 2115*a* is a ring-shaped outer surface of the second connecting portion 2115 adjacent to the inner surface 11 of the cylinder body 1. The arc surface 2115*b* is arranged away from the accommodating groove 2111. The second brazing portion 222 is brazed on the connecting surface 2115*a* of the second connecting portion 2115, and an edge of the second brazing portion 222 (e.g., the bottom edge of the second brazing portion 222 as shown in FIG. 7) away from the accommodating groove 2111 aligns with the arc surface 2115*b* of the second connecting portion 2115 (as shown in FIG. 8).

Additionally, the connecting surfaces 2114*a*, 2114*b* of the first and second connecting portions 2114, 2115 are smooth surfaces for example, but the connecting surfaces 2114*a*, 2114*b* can be formed more roughly for firmly combining to the first and second brazing portions 221, 222.

The gasket 3 and the O-ring 4 are at least partially received in the accommodating groove 2111. The gasket 3 and the O-ring 4 each has a portion protruding from the accommodating groove 2111 and arranged between the first and second brazing portions 221, 222, and the outer surface of the gasket 3 is coplanar with the outer surface of the first brazing portion 221. The O-ring 4 is clipped by the bottom wall 2112 of the accommodating groove 2111 and the inner surface 11 of the cylinder body 1.

Please refer to FIGS. 2, 3, and 5. The spring module 5 has two positioning blocks 51 and a tension spring 52. The positioning blocks 51 are respectively disposed on the bottom of the receiving slot 213 of the spindle 2 and the bottom of the cylinder body 1. The positioning blocks 51 in the instant embodiment are respectively screwed to the spindle 2 and the cylinder body 1 for example, but are not limited thereto. The tension spring 52 is received in the receiving slot 213 of the spindle 2, and two opposite ends of the tension spring 52 are respectively fixed on the two positioning blocks 51.

The push seat 6 is installed on the end portion of the small diameter segment 212 of the main body 21 by screws, such that when the spindle 2 moves along the central axis L with respect to the cylinder body 1, the push seat 6 moves with the spindle 2.

The covering module 7 is arranged at the opening 12 of the cylinder body 1 and at least partially arranged between the outer surface of the small diameter 212 and the inner surface 11 of the cylinder body 1. The covering module 7 contacts the outer surface of the small diameter 212 and the inner surface 11 of the cylinder body 1 without clearance for avoiding the external dust from entering the space 13 via the opening 12 of the cylinder body 1, thereby maintaining smooth operation of the oil hydraulic cylinder 100.

Specifically, the covering module 7 in the instant embodiment includes several components for example. As shown in FIGS. 2 and 5, the covering module 7 has a nut 71, a dustproof seal 72, an abrasion resistant strap 73, and a rubber sleeve 74. The dustproof seal 72, the abrasion resistant strap 73, and the rubber sleeve 74 are approximately ring-shaped, and the dustproof seal 72 and the abrasion resistant strap 73 are spacedly fixed on the inner surface of the nut 71. Moreover, the nut 71, which is configured with the dustproof seal 72 and the abrasion resistant strap 73, is disposed between the outer surface of the small diameter 212 and the inner surface 11 of the cylinder body 1. The inner surfaces of the nut 71, the dustproof seal 72, and the abrasion resistant strap 73 contact the outer surface of the small diameter segment 212 without clearance, and the rubber sleeve 74 contacts the inner surface 11 of the cylinder body 1 without clearance. The rubber sleeve 74 sleeves the outer surface of the top portion of the cylinder body 1 and contacts part of the top surface of the nut 71.

[The Possible Effect of the Instant Disclosure]

In summary, the spindle of the oil hydraulic cylinder of the instant disclosure is formed by brazing the surface protecting coat (e.g., copper coat) on the large diameter segment of the main body, so that when choosing the material of the spindle, the abrasion resistance of the main body can be lower than the abrasion resistance of the surface protecting coat, thereby reducing the cost of the spindle. Moreover, when the surface protecting coat is subject to a certain abrasion, the surface protecting coat can be fixed, such that the spindle can be used again to avoid throwing away the spindle.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An oil hydraulic cylinder, comprising:

a cylinder body having an inner surface, wherein the inner surface defines an opening and a space, and the space is in air communication with the opening;

a spindle defining a central axis, wherein the spindle is movable in the space of the cylinder body along the central axis, and the spindle comprises:

a main body having a large diameter segment and a small diameter segment integrally extended from the large diameter segment, wherein a gap exists between an outer surface of the small diameter segment and the inner surface of the cylinder body, wherein the small diameter segment has an end portion away from the large diameter segment, the end portion of the small diameter segment is arranged at the opening of the cylinder body; and a surface protecting coat being a circular ring shaped copper coat brazed on an outer surface of the large diameter segment, wherein the abrasion resistance of the surface protecting coat is greater than the abrasion resistance of the main body, and the surface protecting coat contacts the inner surface of the cylinder body;

a push seat fixed on the end portion of the small diameter segment; and a covering module arranged at the opening of the cylinder body and at least partially arranged between the outer surface of the small diameter segment and the inner surface of the cylinder body, wherein the covering module abuts the outer surface of the small diameter segment and the inner surface of the cylinder body without any clearance.

2. The oil hydraulic cylinder as claimed in claim 1, wherein the large diameter segment of the main body has a ring-shaped accommodating groove recessed from the outer surface thereof, a center of the accommodating groove is arranged at the central axis; the oil hydraulic cylinder further comprises an O-ring at least partially arranged in the accommodating groove, and the O-ring is clipped between a bottom wall of the accommodating groove and the inner surface of the cylinder body.

3. The oil hydraulic cylinder as claimed in claim 2, wherein the surface protecting coat is divided into a ring-shaped first brazing portion and a ring-shaped second brazing portion by the accommodating groove, a center of the first brazing portion and a center of the second brazing portion are arranged at the central axis, neighboring edges of the first and second brazing portions respectively align with two side walls of the accommodating groove.

4. The oil hydraulic cylinder as claimed in claim 3, wherein the large diameter segment has a first connecting portion and a second connecting portion, the first connecting portion and the second connecting portion are respectively arranged at two opposite sides of the accommodating groove, the first connecting portion is arranged adjacent to the small diameter segment; the first brazing portion and the second brazing portion are respectively brazed on the first connecting portion and the second connecting portion, wherein part of the O-ring protrudes from the accommodating groove and is arranged between the first brazing portion and the second brazing portion.

5. The oil hydraulic cylinder as claimed in claim 4, wherein the first connecting portion has a connecting surface and a flange, the flange is outwardly extended from an edge of the connecting surface adjacent to the small diameter segment, wherein the first brazing portion is brazed on the connecting surface, and an edge of the first brazing portion away from the accommodating groove is brazed on the flange.

6. The oil hydraulic cylinder as claimed in claim 5, wherein the second connecting portion has a connecting surface and an arc surface connecting to the connecting surface thereof, the arc surface is arranged away from the accommodating groove, the second brazing portion is brazed on the connecting surface of the second connecting portion, and an edge of the second brazing portion away from the accommodating groove aligns with the arc surface of the second connecting portion.

7. The oil hydraulic cylinder as claimed in claim 1, wherein the spindle contacts the inner surface of the cylinder body only through the copper coat.

8. A spindle of an oil hydraulic cylinder defining a central axis, comprising:

a main body having a large diameter segment and a small diameter segment integrally extended from the large diameter segment; and a circular ring shaped copper coat brazed on an outer surface of the large diameter segment, wherein a center of the copper coat is arranged at the central axis, the radius of the spindle is greatest at a portion of the spindle coated by the copper coat, and the abrasion resistance of the copper coat is greater than the abrasion resistance of the main body.

9. The spindle of the oil hydraulic cylinder as claimed in claim 8, wherein the large diameter segment of the main body has a ring-shaped accommodating groove recessed from the outer surface thereof, a center of the accommodating groove is arranged at the central axis, the copper coat is divided into a first brazing portion and a second brazing portion by the accommodating groove.

10. The spindle of the oil hydraulic cylinder as claimed in claim 9, wherein the accommodating groove has a bottom wall and two side walls each connected to the bottom wall, the first brazing portion and the second brazing portion are ring shaped, and the radius of the first brazing portion is identical to the radius of the second brazing portion, the adjacent edges of the first and second brazing portions respectively align with the side walls of the accommodating groove.

* * * * *